US006062612A

United States Patent [19]

Lin

[11] Patent Number: 6,062,612

[45] Date of Patent: May 16, 2000

[54] REMOTELY CONTROLLABLE LOCK

[75] Inventor: Jesse Lin, Kaohsiung Hsien, Taiwan

[73] Assignee: Taiwan Fu Hsing Industrial Co., Ltd., Kaohsiung Hsien, Taiwan

[21] Appl. No.: 09/158,451

[22] Filed: Sep. 22, 1998

[51] Int. Cl.[7] ..... E05C 1/06

[52] U.S. Cl. ..... 292/144; 292/336.3; 292/142

[58] Field of Search ..... 70/279.1, 275, 70/277, 278.2, DIG. 73; 292/144, 336.3, 142

[56] References Cited

U.S. PATENT DOCUMENTS

| | | | |
|---|---|---|---|
| 3,733,861 | 5/1973 | Lester | 70/277 |
| 4,843,851 | 7/1989 | Frolov | 70/277 |
| 4,887,442 | 12/1989 | Lavelle | 70/277 |
| 5,027,629 | 7/1991 | Liu | 70/277 |
| 5,083,448 | 1/1992 | Kärkkäinen et al. | 292/144 |
| 5,265,452 | 11/1993 | Dawson | 70/277 |
| 5,447,047 | 9/1995 | Lin . | |
| 5,513,510 | 5/1996 | Solovieff et al. | 70/DIG. 73 |
| 5,611,227 | 3/1997 | Solovieff | 70/DIG. 73 |
| 5,790,034 | 8/1998 | Khoury | 292/144 |
| 5,857,365 | 1/1999 | Armstrong | 70/279 |

*Primary Examiner*—Flemming Saether
*Assistant Examiner*—Teri Pham

[57] ABSTRACT

A remotely controllable lock includes a housing, a motor mounted in the housing, and a control device mounted in the housing for activating the motor. A gear train is mounted in the housing and driven by an output shaft of the motor and has a drive gear. A turn knob has an axle rod extended through an axle tube mounted to the housing. The axle rod is engaged with a driving member for driving a dead bolt of the door lock. When the turn knob is manually turned through a pre-determined angle, the movable plate is moved from a first position representing one of a locked status and an unlocked status of the dead bolt to a second position representing the other one of the locked status and the unlocked status without actuating the drive gear. When the control device receives a signal from remote control that request a change in the status of the dead bolt, the movable plate is moved by the drive gear from one of the first position and the second position to the other of the first position and the second position, and the turn knob is turned through the pre-determined angle.

4 Claims, 5 Drawing Sheets

REMOTELY CONTROLLABLE LOCK

BACKGROUND OF THE INVENTION

1. Field of the Invention

The present invention relates to a lock that can be remotely controlled.

2. Description of the Related Aft

U.S. Pat. No. 5,447,047 to Applicant discloses a dead bolt including an outer lever and an inner lever, a coil disposed in the outer sleeve, a rod slidably engaged in the coil and having two extensions, a shaft coupled between the two levers, and a disc engaged on the shaft and having two grooves for engaging with the extensions of the rod. The extensions of the rod are biased away from the grooves of the disc such that the shaft cannot be rotated by the outer lever, and the rod is caused to move toward the disc when the coil is energized such that the extensions of the rod are caused to engage with the grooves of the disc and such that the shaft can be rotated by the outer lever. Such a structure is complicated. In addition, unlocking from outside is troublesome as the extensions of the rod must be pushed to engage with the grooves of the disc within the energizing time that awaits input of signal. The present invention is intended to provide a simpler structure to solve this problem.

SUMMARY OF THE INVENTION

It is a primary object of the present invention to provide an improved lock that can be locked or unlocked by either manual operation or remote control.

In accordance with the present invention, a remotely controllable lock comprises:

- a housing including an axle tube, the housing further including a switching means and a positioning switch mounted thereon,
- a motor mounted in the housing and having an output shaft,
- a control means mounted in the housing for activating the motor and adapted to be controlled by a remote controller,
- a gear train mounted in the housing and driven by the output shaft of the motor and having a drive gear, the driving gear including an eccentric rib and an arcuate rib provided thereon, in which when the drive wheel is rotated through a pre-determined angle, the eccentric rib activates the positioning switch on the housing to cause the control means to send a signal to stop the motor,
- a turn knob having an axle rod rotatably extended through the axle tube of the housing, the axle rod being adapted to be engaged with a driving member for driving a dead bolt of the lock, the driving gear being freely, rotatably mounted around the axle knob, the turn knob further including a gear securely mounted thereon to rotate therewith, and
- a movable plate movably mounted in the housing, the movable plate:
  - a slot through which the axle rod of the turn knob is extended,
  - an upper block and a lower block provided on an upper end and a lower end thereof, respectively, in which when the driving gear does not rotate, the arcuate rib on the driving gear disengaged from and thus does not interfere with the upper block and the lower block, and
  - an activating rod that activates the switching means to send a signal when the movable plate moves to a predetermined position in a direction.

When the turn knob is manually turned through a pre-determined angle, the movable plate is moved from a first position representing one of a locked status and an unlocked status of the dead bolt to a second position representing the other one of the locked status and the unlocked status without actuating the drive gear. When the control means receives a signal from remote control that request a change in the status of the dead bolt, the movable plate is moved by the drive gear from one of the first position and the second position to the other of the first position and the second position, and the turn knob is turned through the pre-determined angle.

The axle rod includes a non-circular section, and further comprises an elastic member with two lateral sides for holding the non-circular section of the axle rod, and the axle tube includes a pair of notches through which the lateral sides of the elastic member are extended.

When the movable plate moves to one of the first position and the second position, the switching means is activated by the activating rod such that the control means only receives a signal from the remote controller that requests a change in the status of the dead bolt.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
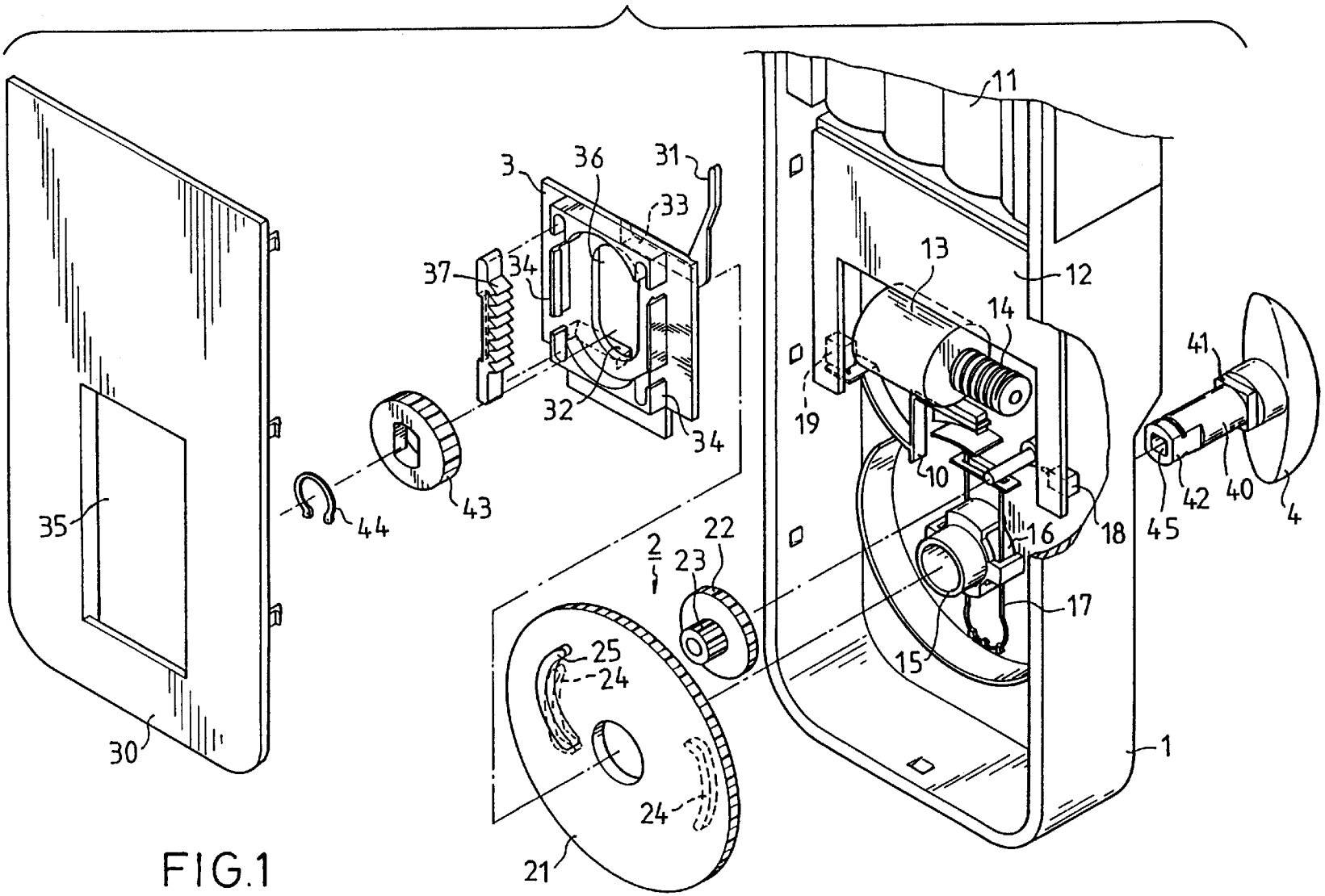
FIG. 1 is an exploded perspective view of a lock in accordance with the present invention.
Figure 2:
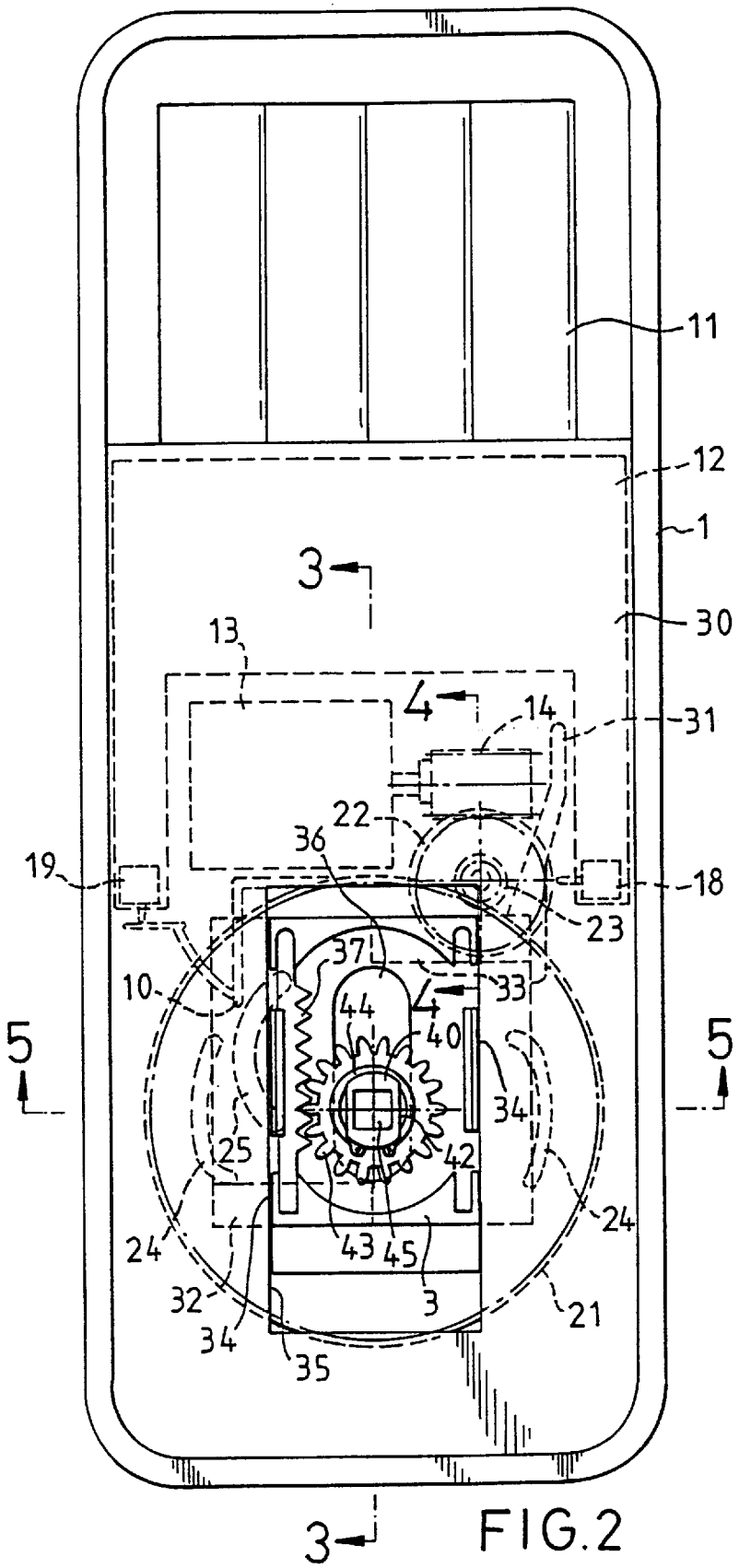
FIG. 2 is a front elevational view, partly cutaway, of the lock of the present invention.

Referring to FIGS. 1 and 2, a remotely controllable lock in accordance with the present invention generally includes a housing 1, a gear train 2, a movable plate 3, and a turn knob 4. The housing 1 includes a battery chamber (not labeled) for receiving a battery unit 11 (FIG. 2), a motor 13 mounted thereon, and a control means 12 that may receive and transmit signals to activate a worm 14 on an output shaft (not labeled) of the motor 13 to rotate. As shown in FIG. 1, the housing 1 includes an axle tube 15 for rotatably receiving an axle rod 40 of the turn knob 4. The axle tube 15 includes a pair of notches 16 through which two lateral sections of a loop-like elastic member 17 are extended to thereby enclose the elastic member 17 and impart an inward force to the elastic member 17 for holding a non-circular section 41 of the axle rod 40. As a result, the turn knob 4 is rotatable and can be stopped at pre-determined positions, which will be described in detail later. The housing 1 further includes a switching means 18 and a positioning switch 19 mounted thereon, which also will be described in detail later.

The gear train 2 includes a number of gears. In this embodiment, the gear train 2 includes a first gear 22 meshed with the worm 14, a second gear 23 securely, concentrically mounted to a side of the first gear 22 to rotate therewith, and a third gear 21 that meshes with the second gear 22 and is freely rotatable around the axle rod 40. The third gear 21 acts as a driving gear and includes a pair of eccentric ribs 24 formed on a first side thereof and an arcuate rib 25 formed on a second side thereof.

The movable plate 3 includes a pair of tracks 34 provided thereon so as to be movable along a vertical direction in a slot 35 of an engaging plate 30 that is securely attached to the housing 1. The movable plate 3 includes an upper block 33 and a lower block 32 respectively provided on upper and lower ends of a side thereof for cooperation with the arcuate rib 25 of the driving gear 21, which will be described later. The movable plate 3 further includes an activating rod 31 for releasable, activating the switching means 18 to inform the control means 12 of a signal from a remote controller (not shown) indicating an upward or downward command of the movable plate 3 for locking or unlocking, which also will be described later. The movable plate 3 further includes an elliptical slot 36 through which the axle rod 40 of the turn knob 4 is extended. Mounted on the movable plate 3 and adjacent to the slot 36 is a rack 37 that meshes with a gear 43 on the axle rod 40. The gear 43 is securely mounted on a non-circular section 42 of the axle rod 40 to rotate therewith. The gear 43 is retained in position by a C-clip 44. The axle rod 40 further includes a non-circular hole 45 defined in a distal end thereof for engaging with a driving member 5 (FIG. 3) that drives a dead bolt (not shown) for locking or unlocking, which is conventional and therefore not further described. It is appreciated that the driving gear 21 is freely rotatable around the axle rod 40 of the turn knob 4.

When the control means 12 receives a signal and forces the motor 13 to turn, the arcuate rib 25 on driving gear 21 impinges the lower block 32 or the upper block 33 and thus forces the movable plate 3 to move downwardly or upwardly. The switching means 18 sends a signal, while one of the eccentric ribs 24 impinges a push rod 10 on the housing 1 to activate the positioning switch 19. As a result, the control means 12 sends a signal to stop the motor 13. When the driving gear 21 stops, the arcuate rib 25 is separate from the upper block 33 and the lower block 32. The movable plate 3 is retained in position as the rack 37 still meshes with the gear 43 on the axle rod 40.

Figure 3:
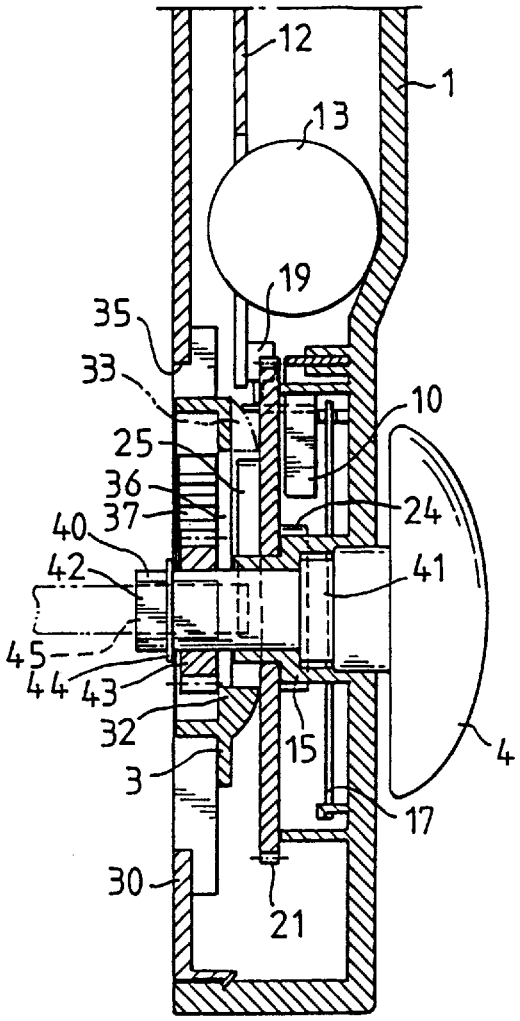
FIG. 3 is a sectional view taken along line 3—3 in FIG. 2.

Referring to FIGS. 2 and 3, if the axle rod 40 of the turn knob 4 received in the axle tube 15 is directly, manually turned through 90°, the driving member 5 is rotated to drive the dead bolt (not shown) for locking or unlocking. It is noted that the axle rod 40 does not drive the driving gear 21. Nevertheless, the gear 43 drives the rack 37 of the movable plate 3. As a result, the movable plate 3 is moved upwardly, yet the upper block 33 and the lower block 32 do not engage with the arcuate rib 25 of the driving gear 2 as the arcuate rib 25 is beyond the travel paths of the upper and lower blocks 33 and 32. Thus, the movable plate 3 is moved by rotational movement of the turn knob 4 without any resistance.

Figure 4:
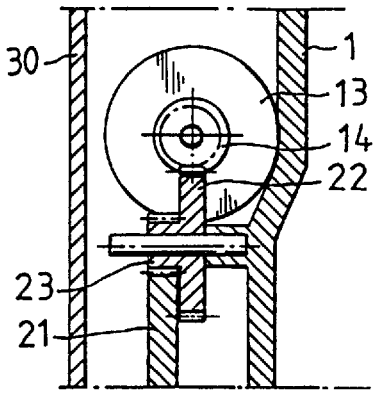
FIG. 4 is a sectional view taken along line 4—4 in FIG. 2.
Figure 5:
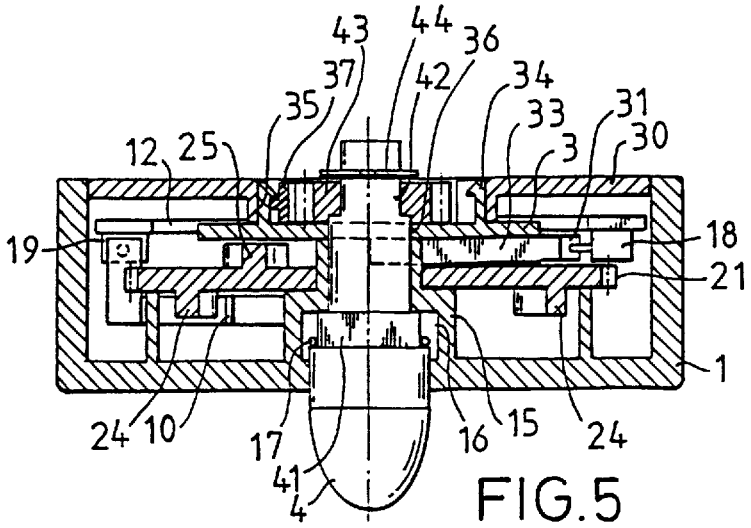
FIG. 5 is a sectional view taken along line 5—5 in FIG. 2.
Figure 6:
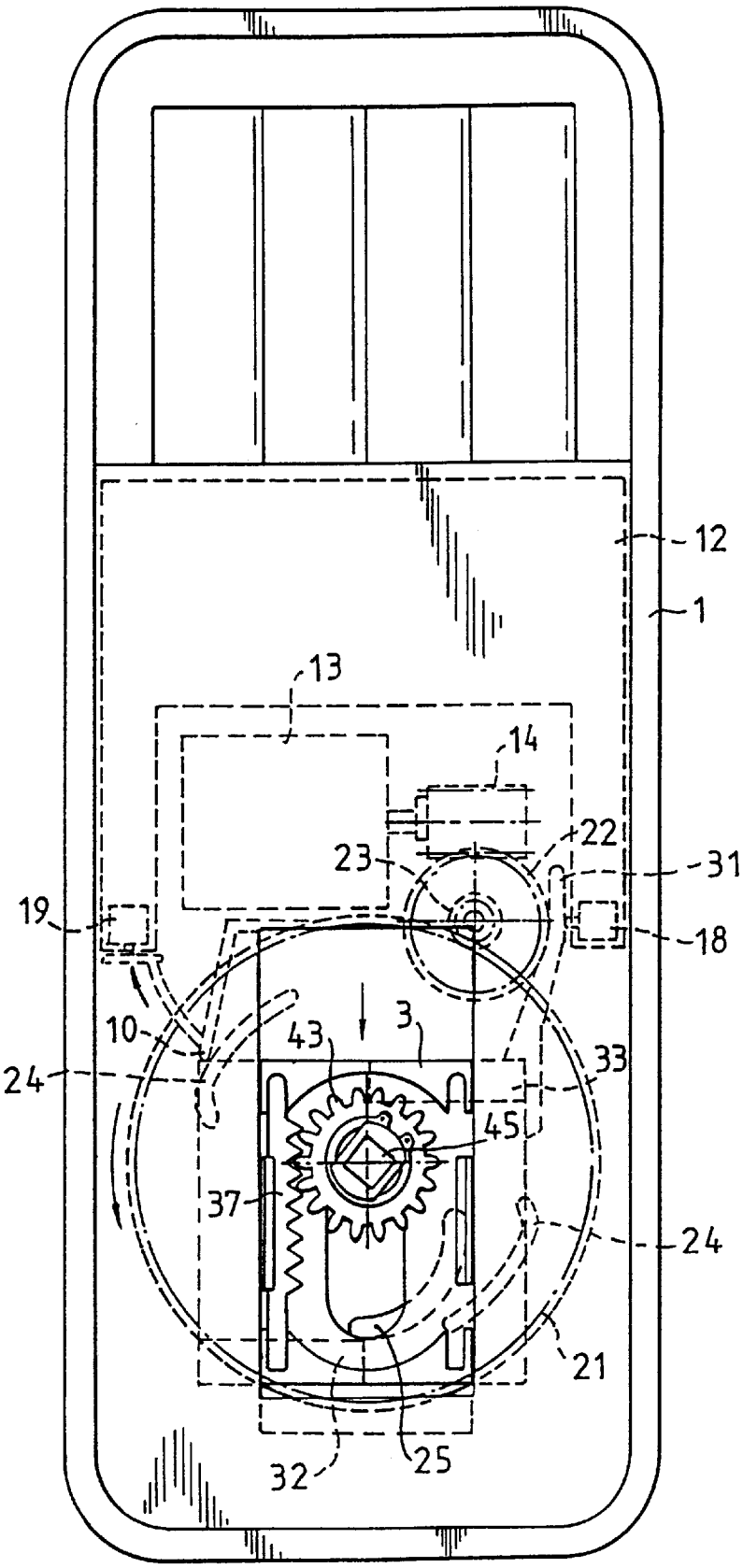
FIG. 6 is a view similar to FIG. 2, illustrating operation of a drive gear.
Figure 7:
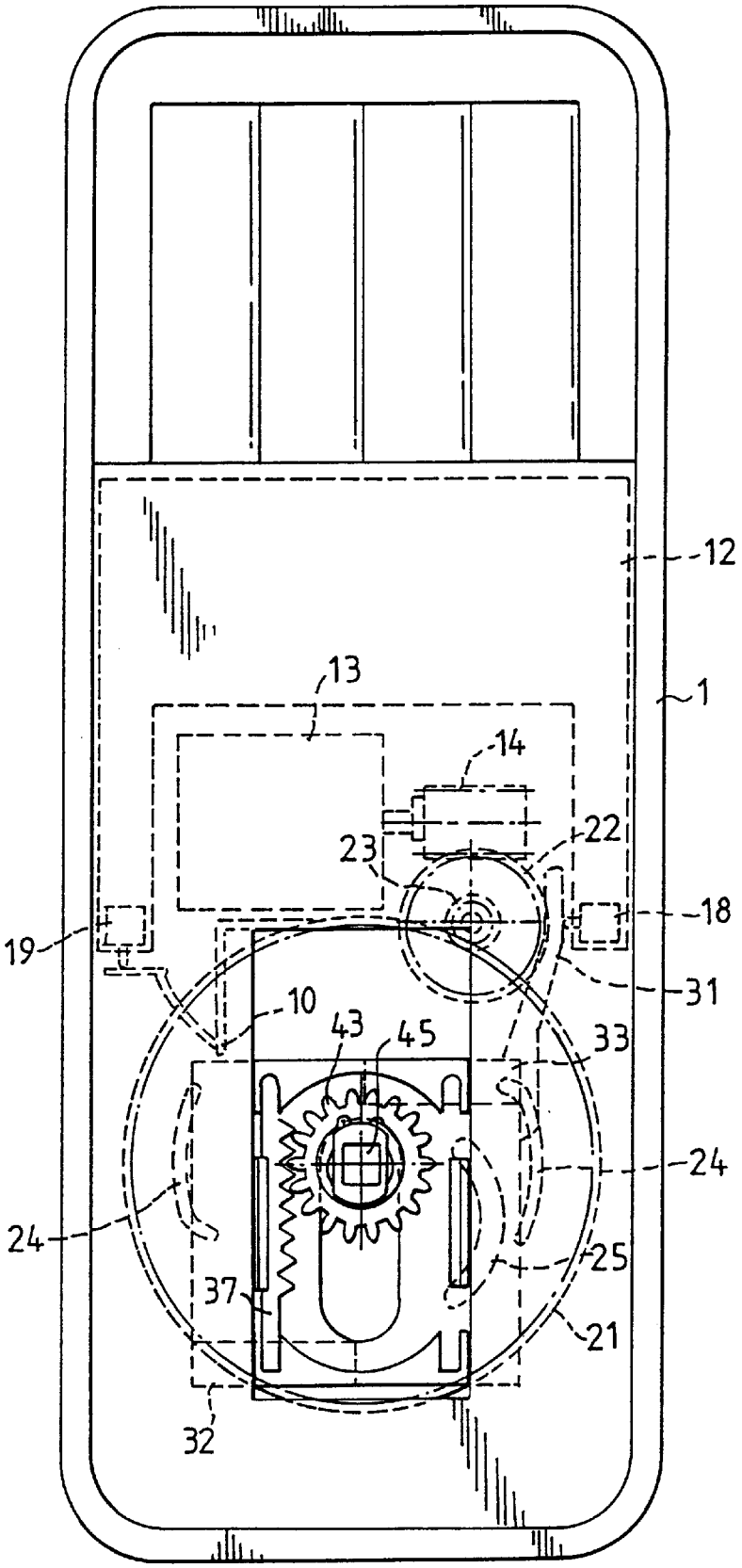
FIG. 7 is a view similar to FIG. 2, in which the lock is an in locked status.

The status of the dead bolt (locking or unlocking) can be identified based on the engagement relationship between the activating rod 31 and the switching means 18. When the dead bolt is in an unlocked status, and if an unlocking signal is sent from the remote controller, the unlocking signal will be ignored. Instead, if a locking signal is sent from the remote controller, referring to FIGS. 2, 4, and 5, the control means 12 activates the motor 13 and thus turns the driving gear 21 through a pre-determined angle. As a result, the arcuate rib 25 impinges and thus moves the lower block 32 such that the movable plate 3 moves upwardly to a position shown in FIG. 7. The activating rod 31 disengages from (or engages with) the switching means 18. Then, the eccentric rib 24 actuates the push rod 10 to activate the positioning switch 19. A signal is sent by the control means 12 to stop the motor 13. Accordingly, the movable plate 3 is stopped. It is noted that latching is achieved during vertical movement of the movable plate 3 as the rack 37 engages with the gear 43 that is securely mounted on the axle rod 40 to rotate therewith. In this embodiment, latching operation is described via upward movement of the movable plate 3. It is appreciated that unlatching operation from a locked status via downward (or upward) movement of the movable plate 3 by either manual or remote control is similar and therefore not further described.

As a result, the lock structure of the present invention is simpler and allows locking/unlocking by either manual operation or remote control.

Although the invention has been explained in relation to its preferred embodiment, it is to be understood that many other possible modifications and variations can be made without departing from the spirit and scope of the invention as hereinafter claimed.

What is claimed is:

1. A remotely controllable lock, comprising:

a housing including an axle tube, the housing further including a switching means and a positioning switch mounted thereon, a motor mounted in the housing, said motor having an output shaft, a control means for activation by a remote controller, said control means is mounted in the housing for activating the motor, a gear train mounted in the housing and driven by the output shaft of the motor, said gear train having a driving gear, the driving gear including an eccentric rib and an arcuate rib provided thereon, in which when the driving gear is rotated through a pre-determined angle, the eccentric rib activates the positioning switch on the housing to cause the control means to send a signal to stop the motor, a turn knob having an axle rod rotatably extended through the axle tube of the housing, the axle rod being adapted to be engaged with a driving member for driving a dead bolt of the lock, the driving gear being freely, rotatably mounted around the axle rod, the turn knob further including a gear securely mounted thereon to rotate therewith, and a movable plate movably mounted in the housing, the movable plate including:

a slot through which the axle rod of the turn knob is extended, an upper block and a lower block provided on an upper end and a lower end thereof, respectively, in which when the driving gear does not rotate, the arcuate rib on the driving gear disengaged from and thus does not interfere with the upper block and the lower block, and an activating rod which activates the switching means to send a signal when the movable plate moves to a pre-determined position in a direction, whereby when the turn knob is manually turned through a pre-determined angle, the movable plate is moved from a first position representing one of a locked status and an unlocked status of the dead bolt to a second position representing the other one of the locked status and the unlocked status without actuating the driving gear, and whereby when the control means receives a signal from a remote controller that request a change in the status of the dead bolt, the movable plate is moved by the driving gear from one of the first position and the second position to the other of the first position and the second position, and the turn knob is turned through the pre-determined angle.

2. The remotely controllable lock as claimed in claim 1, wherein the axle rod includes a non-circular section, and further comprises an elastic member with two lateral sides for holding the non-circular section of the axle rod, and the axle tube includes a pair of notches through which the lateral sides of the elastic member are extended.

3. The remotely controllable lock as claimed in claim 1, wherein when the movable plate moves to one of the first position and the second position, the switching means is activated by the activating rod such that the control means only receives a signal from the remote controller that requests a change in the status of the dead bolt.

4. A remotely controllable lock, comprising:

a housing including an axle tube, the housing further including a switching arrangement and a positioning switch mounted thereon, a motor mounted in the housing, said motor having an output shaft, a control device for activation by a remote controller, said control device mounted in the housing for activating the motor, a gear train mounted in the housing and driven by the output shaft of the motor, said gear train having a driving gear, the driving gear including an eccentric rib and an arcuate rib provided thereon, in which when the driving gear is rotated through a pre-determined angle, the eccentric rib activates the positioning switch on the housing to cause the control device to send a signal to stop the motor, a turn knob having an axle rod rotatably extended through the axle tube of the housing, the axle rod being adapted to be engaged with a driving member for driving a dead bolt of the lock, the driving gear being freely, rotatably mounted around the axle rod, the turn knob further including a gear securely mounted thereon to rotate therewith, and a movable plate movably mounted in the housing, the movable plate including:

a slot through which the axle rod of the turn knob is extended, an upper block and a lower block provided on an upper end and a lower end thereof, respectively, in which when the driving gear does not rotate, the arcuate rib on the driving gear disengaged from and thus does not interfere with the upper block and the lower block, and an activating rod which activates the switching arrangement to send a signal when the movable plate moves to a pre-determined position in a direction, whereby when the turn knob is manually turned through a pre-determined angle, the movable plate is moved from a first position representing one of a locked status and an unlocked status of the dead bolt to a second position representing the other one of the locked status and the unlocked status without actuating the driving gear, and whereby when the control device receives a signal from a remote controller that request a change in the status of the dead bolt, the movable plate is moved by the driving gear from one of the first position and the second position to the other of the first position and the second position, and the turn knob is turned through the pre-determined angle.

* * * * *